US006755393B2

(12) United States Patent
Yamasaki

(10) Patent No.: US 6,755,393 B2
(45) Date of Patent: Jun. 29, 2004

(54) DRIVE SHEAVE OF ELEVATOR

(75) Inventor: Shinji Yamasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 106 days.

(21) Appl. No.: 10/239,390

(22) PCT Filed: Feb. 13, 2001

(86) PCT No.: PCT/JP01/00978

§ 371 (c)(1),
(2), (4) Date: Sep. 23, 2002

(87) PCT Pub. No.: WO02/064483

PCT Pub. Date: Aug. 22, 2002

(65) Prior Publication Data

US 2003/0040386 A1 Feb. 27, 2003

(51) Int. Cl.[7] ..... B66D 3/08
(52) U.S. Cl. ..... 254/393; 29/892.1; 474/176
(58) Field of Search ..... 254/389, 390, 254/393; 474/175, 176, 185, 892.1

(56) References Cited

U.S. PATENT DOCUMENTS 2,212,779 A * 8/1940 Klein ..... 474/176
3,354,735 A 11/1967 Holz
4,030,569 A * 6/1977 Berkovitz ..... 187/254
4,284,409 A * 8/1981 Van Teslaar ..... 474/185

FOREIGN PATENT DOCUMENTS

| | | |
|---|---|---|
| GB | 2 127 934 | 4/1984 |
| JP | 52-59442 | 5/1977 |
| JP | 59-12444 | 8/1978 |
| JP | 56-166356 | of 1981 |
| JP | 60-56670 | 4/1985 |

* cited by examiner

*Primary Examiner*—Emmanuel Marcelo
(74) *Attorney, Agent, or Firm*—Leydig, Voit & Mayer, Ltd.

(57) ABSTRACT

In an elevator drive sheave, positioning of divided segments in a circumferential direction relative to a sheave body and transmission of torque between the sheave body and the divided segments are performed by a torque transmission mechanism having a plurality of keys interposed between the sheave body and the divided segments. A projecting portion projecting radially inward is disposed on an axial end portion of the divided segments, a contact surface being disposed on the projecting portions. Positioning of the divided segments in an axial direction relative to the sheave body is performed by the contact surface being placed in contact with an axial end surface of the sheave body.

7 Claims, 11 Drawing Sheets

DRIVE SHEAVE OF ELEVATOR

TECHNICAL FIELD

The present invention relates to an elevator drive sheave disposed on a hoisting machine onto which a main rope for suspending a car is wound, the elevator drive sheave being rotated by a driving force from a motor portion of the hoisting machine.

BACKGROUND ART

FIG. 10 is a side elevation showing a conventional elevator hoisting machine such as shown in Japanese Utility Model Publication No. SHO 59-12444, for example, partially sectioned. The elevator hoisting machine in the figure includes: a motor portion 1; a rotating shaft 2 rotated by this motor portion 1; a bearing portion 3 for supporting the rotating shaft 2; a drive sheave 4 rotated together with the rotating shaft 2; and an electromagnetic brake 5 for braking rotation of the drive sheave 4.

The drive sheave 4 includes: a rope groove portion 4*a* onto which a main rope (not shown) is wound; and a brake drum portion 4*b* braked by the electromagnetic brake 5.

In a conventional elevator hoisting machine such as described above, it has been necessary to perform correction work on the rope groove portion 4*a* since the rope groove portion 4*a* is abraded by friction with the main rope. It has been necessary to perform correction work on the rope groove portion 4*a* particularly frequently when the drive sheave 4 is disposed outdoors due to the effects of weather and dust.

Since correction work of this kind is performed by removing the entire drive sheave 4 from the hoisting machine, a great deal of time and cost have been required, and operating efficiency of such elevators has also been reduced.

In regard to this, FIG. 11 is a front elevation showing part of another example of a conventional drive sheave, and FIG. 12 is a cross section taken along line XII—XII in FIG. 11.

The drive sheave in the figures includes a sheave body 6 and a plurality of divided segments 7. A brake drum portion 6*a* is disposed on the sheave body 6. A rope groove portion 7*a* is disposed on the divided segments 7. The divided segments 7 are fixed to the sheave body 6 by a plurality of radial bolts 8 and a plurality of axial bolts 9.

Using a drive sheave of this kind, since it is sufficient simply to remove the divided segments 7 from the sheave body 6 when performing correction work on the rope groove portion 7*a* without removing the sheave body 6 from the rotating shaft, the correction work can be performed easily in a short period of time, enabling costs to be reduced and also enabling reductions in the operating efficiency of the elevator to be prevented.

However, in a conventional drive sheave of this kind, parts construction is complicated because of transmission of torque between the divided segments 7 and the sheave body 6, positioning of the divided segments 7 in an axial direction, etc., and complicated machining has been required on the parts, increasing costs.

DISCLOSURE OF THE INVENTION

The present invention aims to solve the above problems and an object of the present invention is to provide an elevator drive sheave enabling correction work on a rope groove portion to be performed easily and enabling costs to be reduced by a simple construction.

According to one aspect of the present invention, there is provided an elevator drive sheave disposed on a hoisting machine onto which a main rope for suspending a car is wound, the elevator drive sheave being rotated by a driving force from a motor portion of the hoisting machine, wherein the elevator drive sheave includes: a sheave body having a cylindrical main body outer circumferential surface; a plurality of divided segments divided in a circumferential direction of the sheave body, each mounted to the main body outer circumferential surface and formed with a rope groove portion into which the main rope is inserted; and a torque transmission mechanism in which a plurality of keys are interposed between the sheave body and the divided segments for positioning the divided segments in a circumferential direction relative to the sheave body and transmitting torque between the sheave body and the divided segments, a contact surface being disposed on the divided segments for positioning the divided segments in an axial direction relative to the sheave body by being placed in contact with an axial end surface of the sheave body.

BEST MODE FOR CARRYING OUT THE INVENTION

Preferred embodiments of the present invention will now be explained with reference to the drawings.

Embodiment 1

Figure 1:
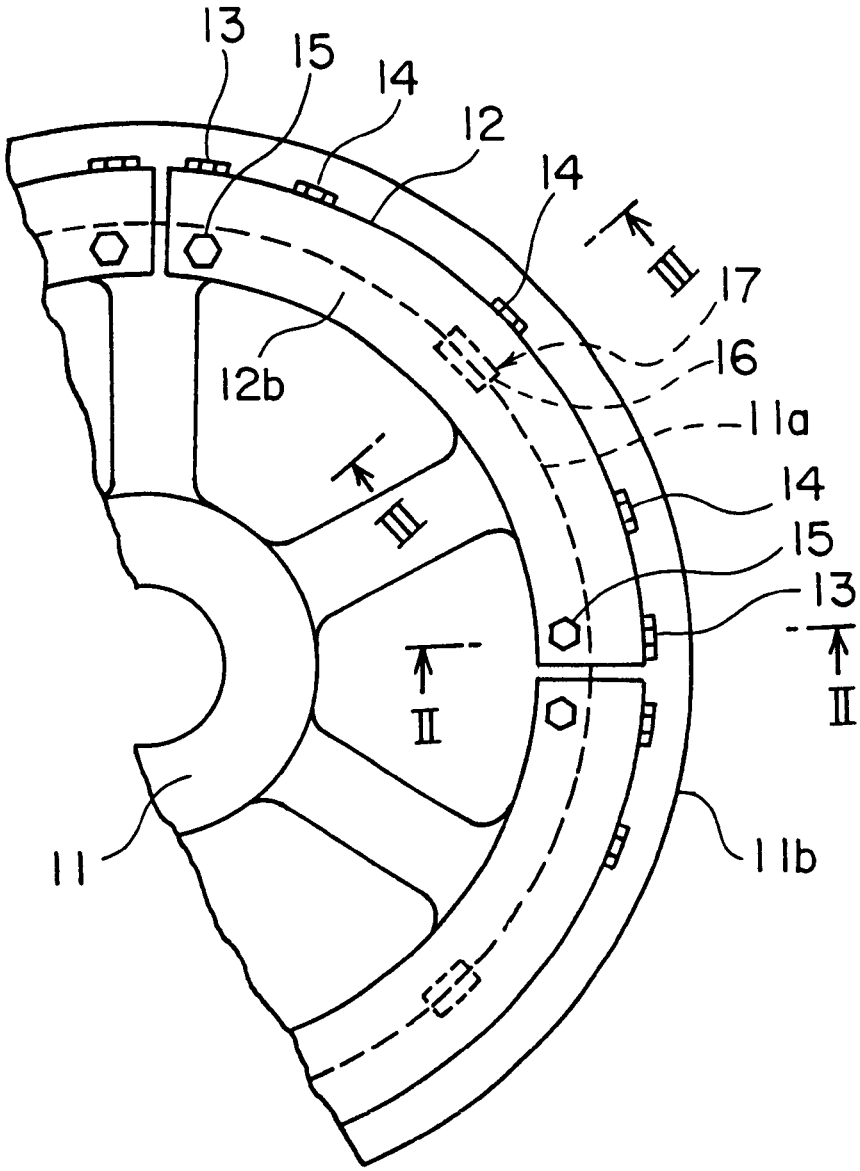
FIG. 1 is a front elevation showing part of an elevator drive sheave according to Embodiment 1 of the present invention.
Figure 2:
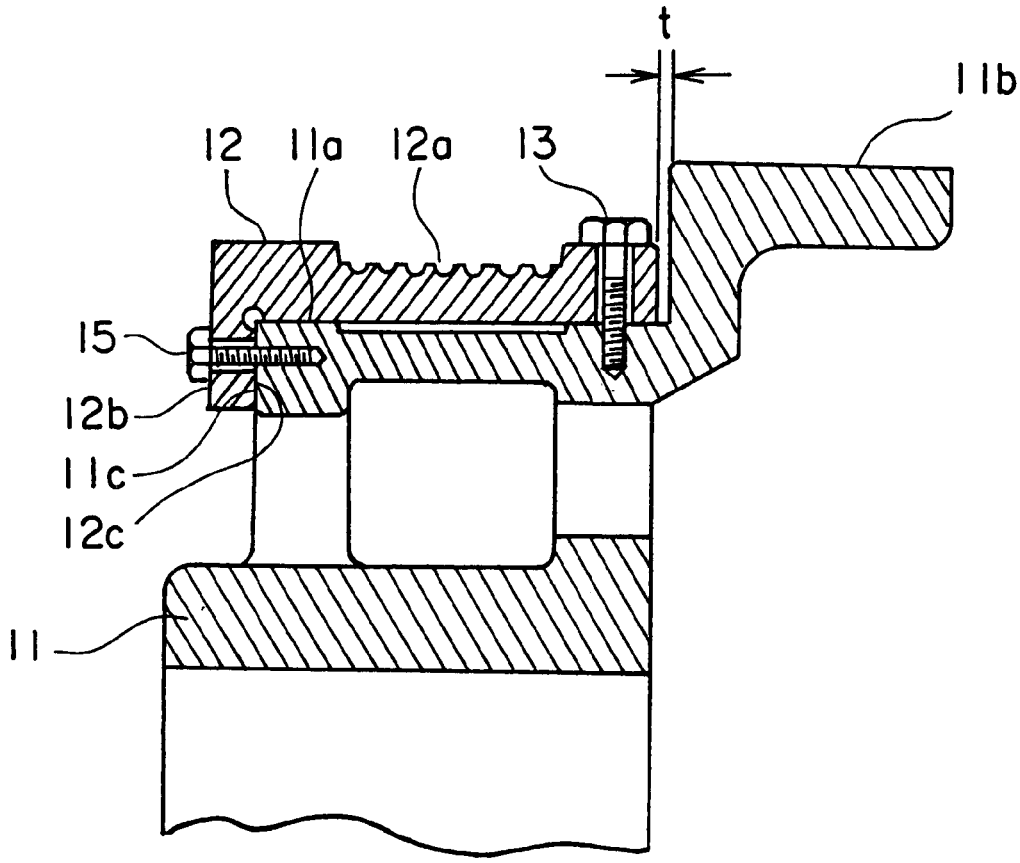
FIG. 2 is a cross section taken along line II—II in FIG. 1.
Figure 3:
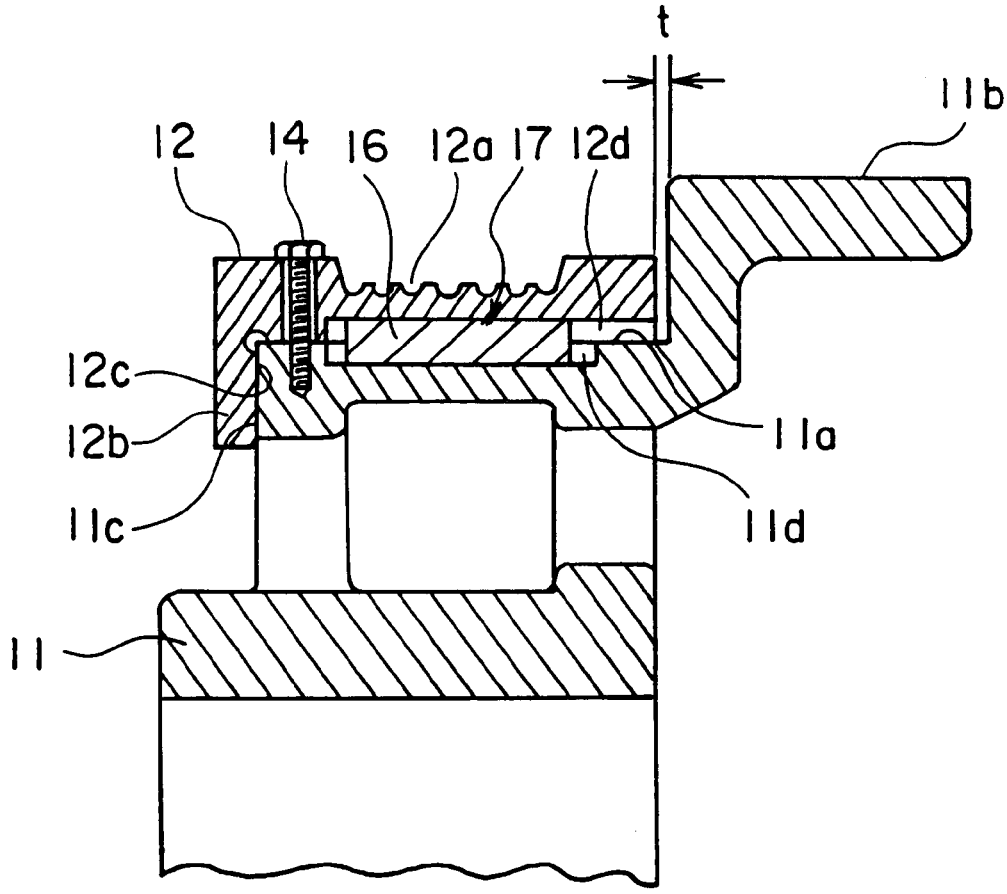
FIG. 3 is a cross section taken along line III—III in FIG. 1.

FIG. 1 is a front elevation showing part of an elevator drive sheave according to Embodiment 1 of the present invention, FIG. 2 is a cross section taken along line II—II in FIG. 1, and FIG. 3 is a cross section taken along line III—III in FIG. 1.

The drive sheave in the figures includes: a sheave body 11; and a plurality of arc-shaped divided segments 12 divided in a circumferential direction of the sheave body 11. The sheave body 11 includes: a cylindrical main body outer circumferential surface 11*a*; and a brake drum portion 11*b*.

A rope groove portion 12*a* into which a main rope (not shown) is inserted is disposed on the divided segments 12. The divided segments 12 are fixed to the main body outer circumferential surface 11*a* of the sheave body 11 by means of a plurality of radial bolts 13 and 14 extending in a radial direction of the sheave body 11 and a plurality of axial bolts 15 extending in an axial direction of the sheave body 11.

Diameters of apertures in the divided segments 21 through which the radial bolts 13 and 14 and the axial bolts 15 pass have clearance relative to the diameter of the corresponding bolts 13, 14, and 15.

Projecting portions 12*b* projecting radially inward are disposed on axial end portions of the divided segments 12. Contact surfaces 12*c* for positioning the divided segments 12 in an axial direction relative to the sheave body 11 by being placed in contact with an axial end surface 11*c* of the sheave body 11 are disposed on the projecting portions 12*b*. When the contact surfaces 12*c* are placed in contact with the end surface 11*c*, there is a gap t between the divided segments 12 and the brake drum portion 11*b*.

Keyways 11*d* and 12*d* are disposed on the sheave body 11 and the divided segments 12, respectively. A key 16 is inserted into the key ways 11*d* and 12*d*. A torque transmission mechanism 17 includes the keyways 11*d* and 12*d* and the key 16. The torque transmission mechanism 17 positions the divided segments 12 in a circumferential direction relative to the sheave body 11 and transmits torque between the sheave body 11 and the divided segments 12.

Using a drive sheave of this kind, correction work on the rope groove portion 12*a* and replacement of the divided segments 12 can be performed easily by removing the divided segments 12 from the sheave body 11, enabling costs for maintenance to be reduced and also enabling reductions in the operating efficiency of the elevator to be prevented.

Furthermore, positioning of the divided segments 12 in the axial direction can be performed easily, simply by placing the contact surfaces 12*c* in contact with the end surface 11*c*, also enabling mutual positioning of the rope groove portions 12*a* to be performed easily.

In addition, since the transmission of torque is performed mainly by the key 16, it is sufficient for the bolts 13, 14, and 15 simply to secure the divided segments 12 to the sheave body 11, enabling dimensions of the bolts 13, 14, and 15 to be reduced.

Embodiment 2

Figure 4:
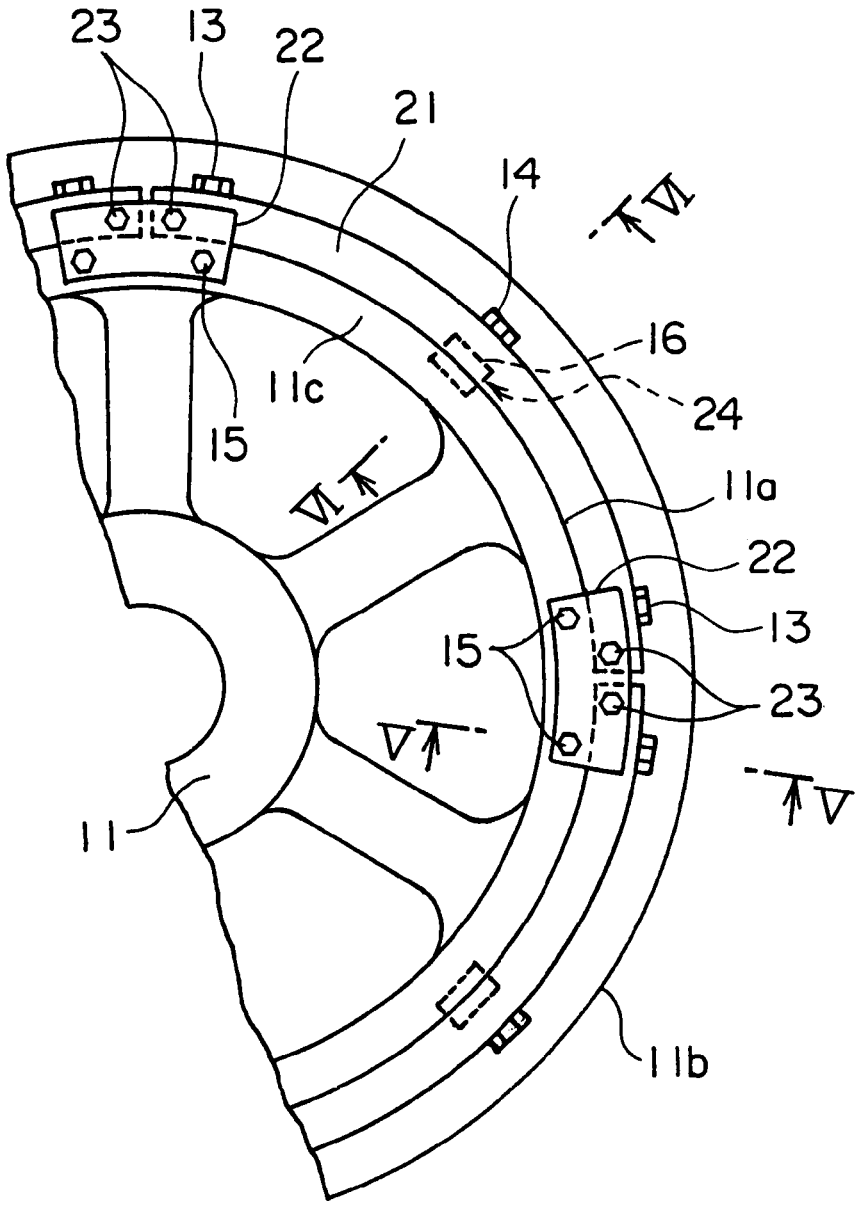
FIG. 4 is a front elevation showing part of an elevator drive sheave according to Embodiment 2 of the present invention.
Figure 5:
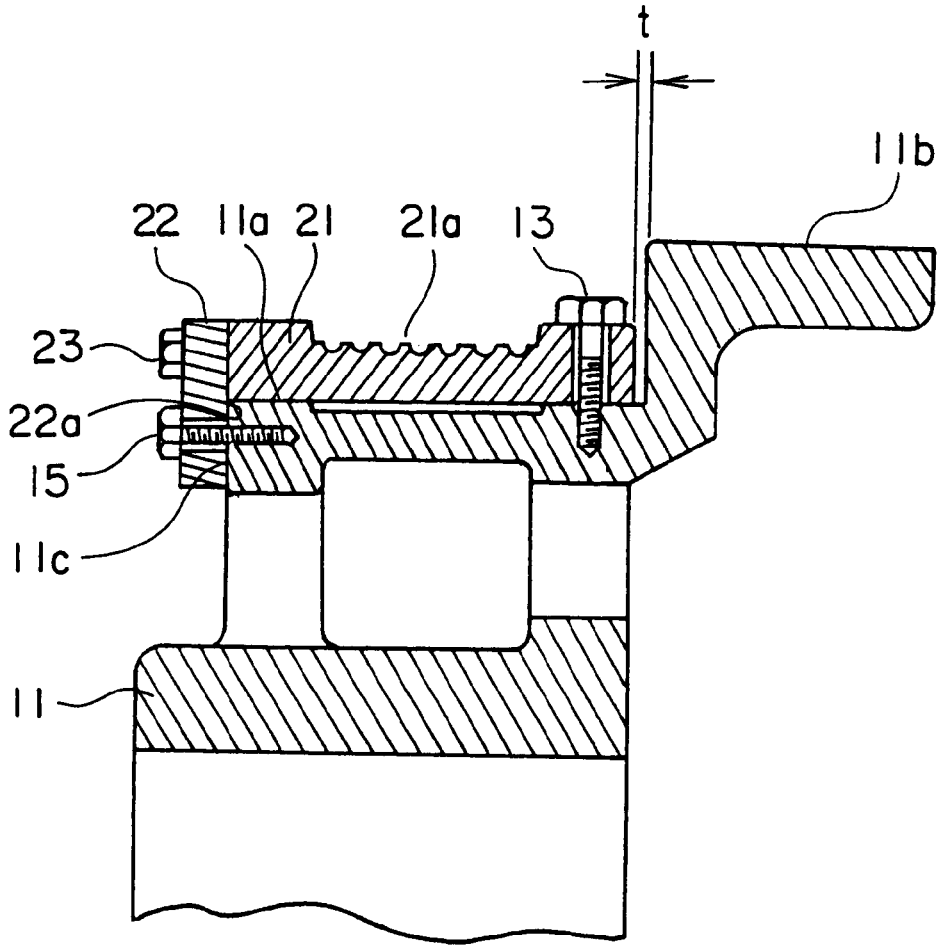
FIG. 5 is a cross section taken along line V—V in FIG. 4.
Figure 6:
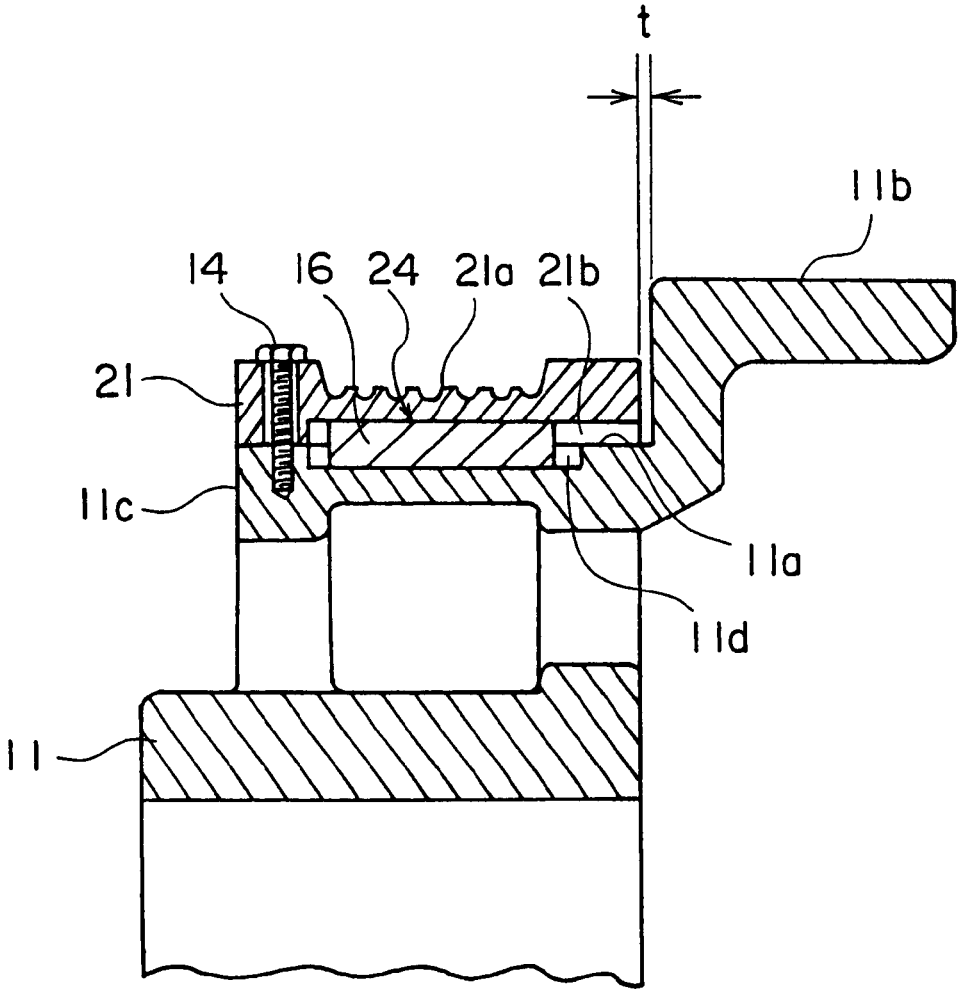
FIG. 6 is a cross section taken along line VI—VI in FIG. 4.

Next, FIG. 4 is a front elevation showing part of an elevator drive sheave according to Embodiment 2 of the present invention, FIG. 5 is a cross section taken along line V—V in FIG. 4, and FIG. 6 is a cross section taken along line VI—VI in FIG. 4.

The drive sheave in the figures includes: a sheave body 11; and a plurality of arc-shaped divided segments 21 divided in a circumferential direction of the sheave body 11. The sheave body 11 includes: a cylindrical main body outer circumferential surface 11*a*; and a brake drum portion 11*b*.

A rope groove portion 21*a* into which a main rope (not shown) is inserted is disposed on the divided segments 21. The divided segments 21 are fixed to the main body outer circumferential surface 11*a* of the sheave body 11 by means of a plurality of radial bolts 13 and 14 extending in radial directions of the sheave body 11. Diameters of apertures in the divided segments 21 through which the radial bolts 13 and 14 pass have clearance relative to the diameter of the radial bolts 13 and 14.

A plurality of linking members 22 also functioning as positioning members are fixed to axial end portions of the divided segments 21. The linking members 22 are fixed to divided segments 21 that are adjacent to each other by mounting bolts 23, linking the divided segments 21 that are adjacent to each other.

Contact surfaces 22*a* for positioning the divided segments 21 in an axial direction relative to the sheave body 11 by being placed in contact with an axial end surface 11*c* of the sheave body 11 are disposed on the linking members 22. When the contact surfaces 22*a* are placed in contact with the end surface 11*c*, there is a gap t between the divided segments 21 and the brake drum portion 11*b*.

The linking members 22 are fixed to the sheave body 11 by a plurality of axial bolts 15 extending in the axial direction of the sheave body 11. Diameters of apertures in the linking members 22 through which the axial bolts 15 pass have clearance relative to the diameter of the axial bolts 15.

Keyways 11*d* and 21*b* are respectively disposed on the sheave body 11 and the divided segments 21. A key 16 is inserted into the keyways 11*d* and 21*b*. A torque transmission mechanism 24 includes the keyways 11*d* and 21*b* and the key 16. The torque transmission mechanism 24 positions the divided segments 21 in a circumferential direction relative to the sheave body 11 and transmits torque between the sheave body 11 and the divided segments 21.

Using a drive sheave of this kind, correction work on the rope groove portion 21*a* and replacement of the divided segments 21 can be performed easily by removing the divided segments 21 from the sheave body 11, enabling costs for maintenance to be reduced and also enabling reductions in the operating efficiency of the elevator to be prevented.

Furthermore, positioning of the divided segments 21 in the axial direction can be performed easily, simply by mounting the linking members 22 to the divided segments 21 and placing the contact surfaces 22*a* in contact with the end surface 11*c*, also enabling mutual positioning of the rope groove portions 21*a* to be performed easily.

In addition, since the transmission of torque is performed mainly by the key 16, it is sufficient for the bolts 13, 14, and 15 simply to secure the divided segments 21 and the linking members 22 to the sheave body 11, enabling dimensions of the bolts 13, 14, and 15 to be reduced.

Still furthermore, because the linking members 22 for positioning the divided segments 21 in the axial direction are made as separate bodies from the divided segments 21, the shapes of the divided segments 21 are simplified, simplifying machining of the divided segments 21 and enabling the cost of parts to be reduced. Furthermore, the weight of the divided segments 21 is reduced, facilitating handling.

Embodiment 3

Figure 7:
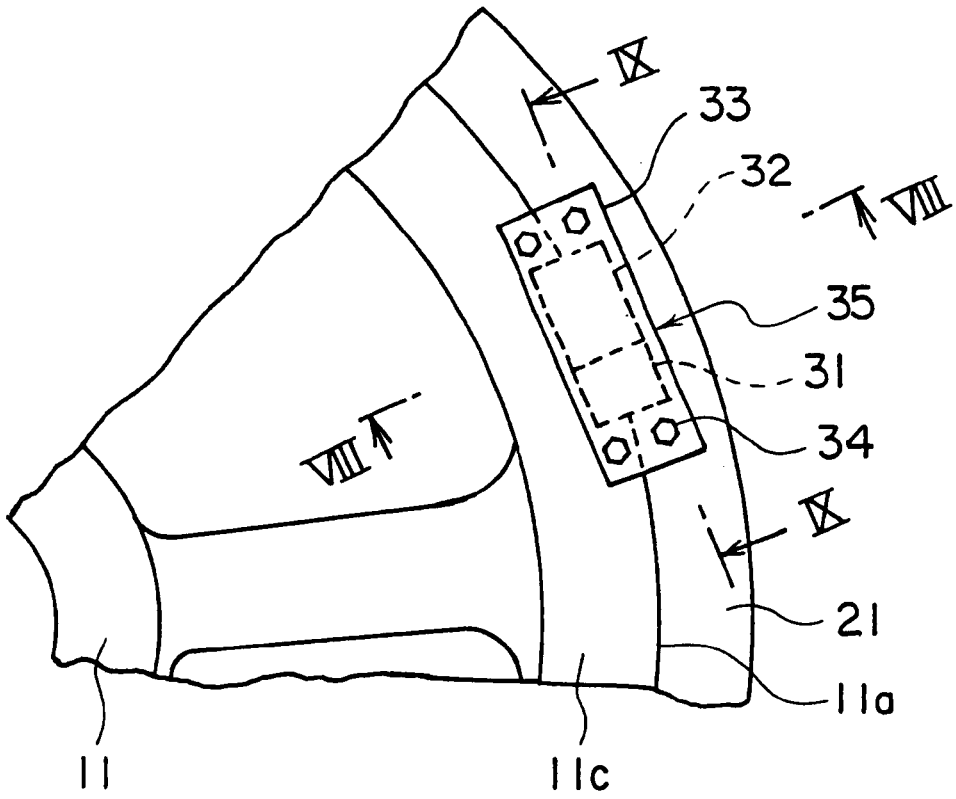
FIG. 7 is a front elevation showing part of an elevator drive sheave according to Embodiment 3 of the present invention.
Figure 8:
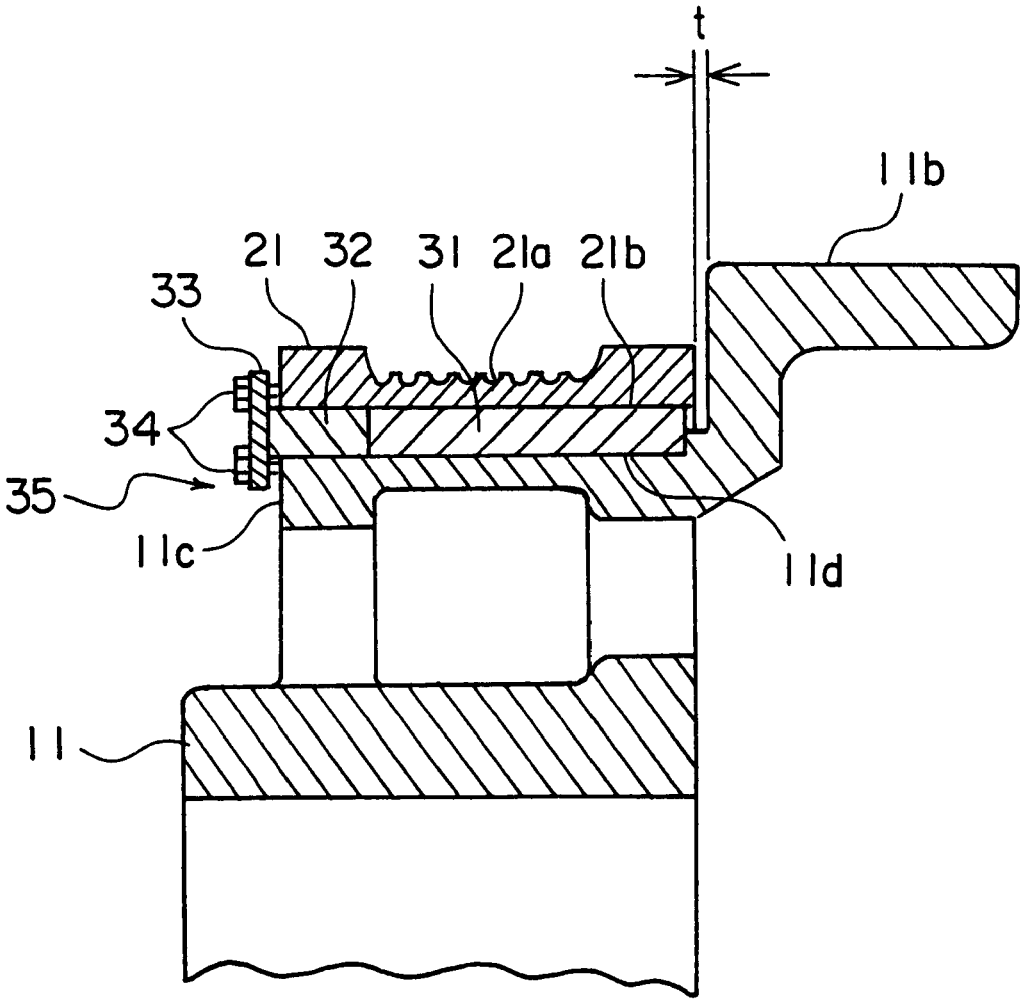
FIG. 8 is a cross section taken along line VIII—VIII in FIG. 7.
Figure 9:
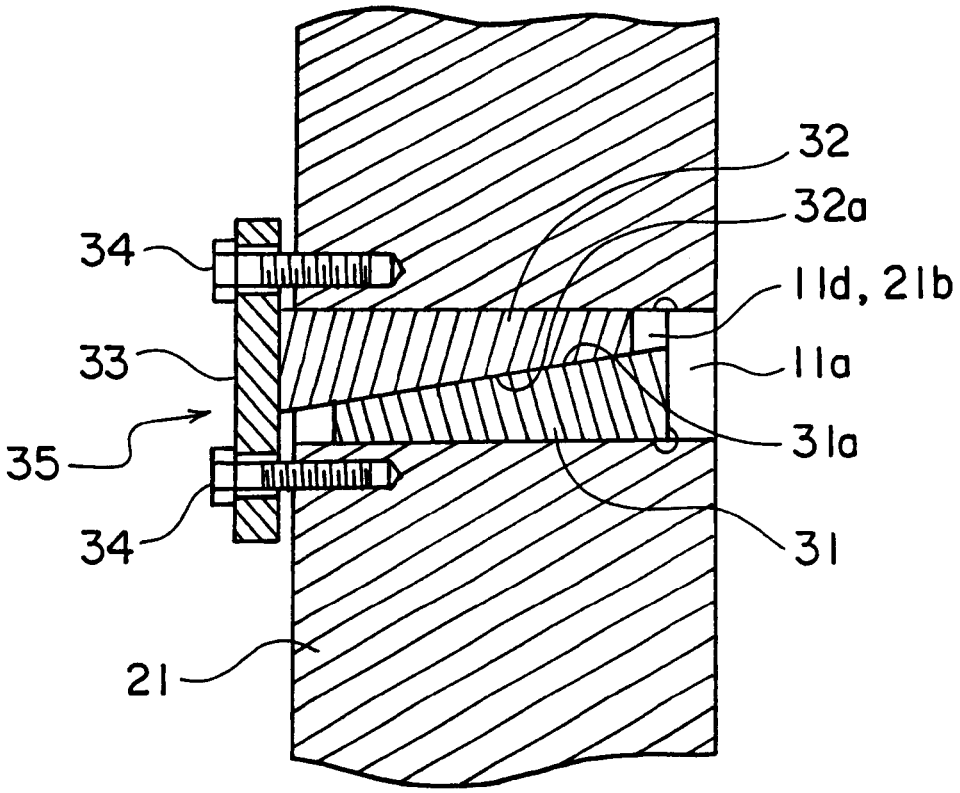
FIG. 9 is a cross section taken along line IX—IX in FIG. 7.
Figure 10:
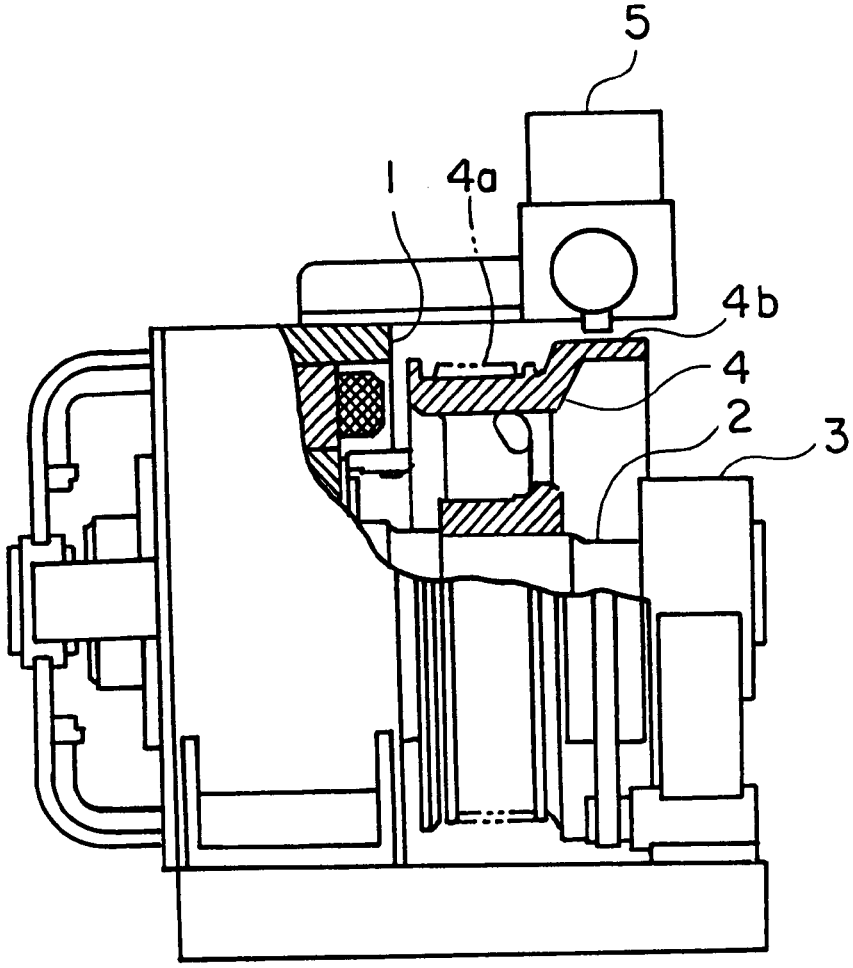
FIG. 10 is a side elevation showing an example of a conventional elevator hoisting machine partially sectioned.
Figure 11:
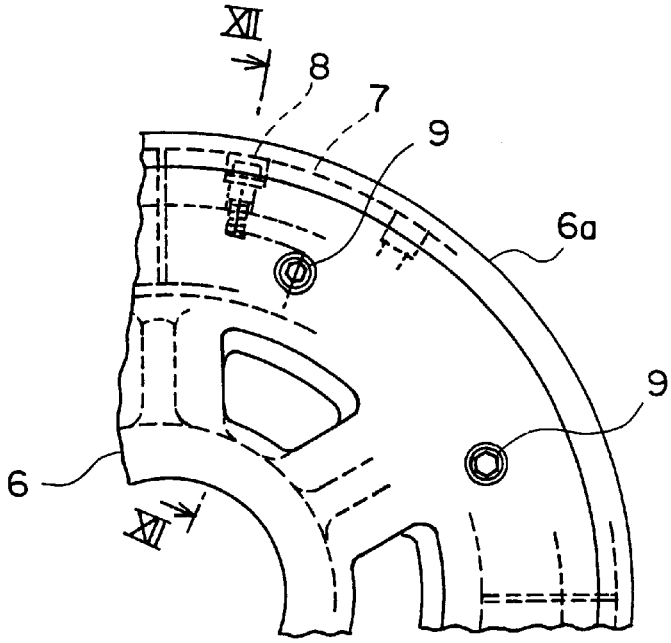
FIG. 11 is a front elevation showing part of another example of a conventional drive sheave.
Figure 12:
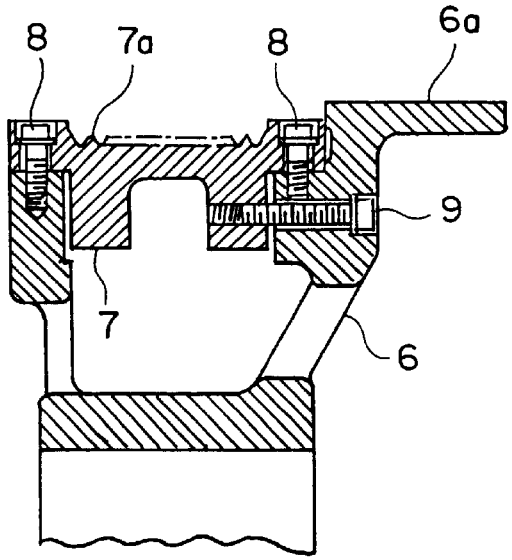
FIG. 12 is a cross section taken along line XII—XII in FIG. 11.

Next, FIG. 7 is a front elevation showing part of an elevator drive sheave according to Embodiment 3 of the present invention, FIG. 8 is a cross section taken along line VIII—VIII in FIG. 7, and FIG. 9 is a cross section taken along line IX—IX in FIG. 7.

In the figure, first and second one-sided taper keys 31 and 32 are inserted inside the keyways 11*d* and 21*b*. The first and second one-sided taper keys 31 and 32 have first and second one-sided taper surfaces 31*a* and 32*a* in contact with each other. A pressing member 33 for pushing the second one-sided taper key 32 inside the keyways 11*d* and 21*b* is mounted to the sheave body 11 and the divided segment 21 by a plurality of locking bolts 34.

A torque transmission mechanism 35 includes the keyways 11*d* and 21*b*, the first and second one-sided taper keys 31 and 32, the pressing member 33, and the locking bolts 34. The rest of the construction is similar to that of Embodiment 2.

In a drive sheave of this kind, the second one-sided taper key 32 is pushed inside the keyways 11*d* and 21*b* by means of the pressing member 33 by tightening the locking bolts 34, eliminating gaps between the first and second one-sided taper keys 31 and 32 and the keyways 11*d* and 21*b*, thereby enabling smoother, more reliable torque transmission to be achieved, in turn enabling riding comfort of the elevator to be improved.

What is claimed is:

1. An elevator drive sheave disposed on a hoisting machine onto which a main rope for suspending a car is wound, the elevator drive sheave being rotated by a driving force from a motor portion of the hoisting machine, wherein said elevator drive sheave comprises:

a sheave body having a cylindrical main body outer circumferential surface;

a plurality of divided segments divided in a circumferential direction of said sheave body, each divided segment being mounted to said main body outer circumferential surface and including a rope groove portion into which the main rope is inserted; and a torque transmission mechanism including a plurality of keys interposed between said sheave body and said divided segments for positioning said divided segments in a circumferential direction relative to said sheave body and transmitting torque between said sheave body and said divided segments, a contact surface on said divided segments positioning said divided segments in an axial direction relative to said sheave body by contacting an axial end surface of said sheave body.

2. The elevator drive sheave according to claim 1, wherein said torque transmission mechanism has a plurality of keyways disposed in said sheave body and said divided segments, respectively, said keys being inserted into said plurality of keyways.

3. The elevator drive sheave according to claim 1, including a projecting portion projecting radially inward and disposed on an axial end portion of said divided segments, said contact surface being disposed on said projecting portion.

4. The elevator drive sheave according to claim 1, wherein said divided segments are mounted to said sheave body by a plurality of radial bolts extending in a radial direction of said sheave body and a plurality of axial bolts extending in an axial direction of said sheave body.

5. The elevator drive sheave according to claim 1, including a positioning member fixed to an axial end portion of said divided segments, said contact surface being disposed on said positioning member.

6. The elevator drive sheave according to claim 5, wherein said positioning member links divided segments that are adjacent to each other.

7. The elevator drive sheave according to claim 1, wherein said torque transmission mechanism includes:

a plurality of keyways disposed in said sheave body and said divided segments, respectively;

a first one-sided taper key inserted inside a first of said keyways, said first one-sided taper key having a first one-sided taper surface;

a second one-sided taper key inserted inside the first of said keyways, said second one-sided taper key having a second one-sided taper surface in contact with said first one-sided taper surface; and a pressing member mounted to said sheave body and said divided segments for pushing said second one-sided taper key inside the first of said keyways.

* * * * *